US005526969A

United States Patent [19]

Greenberger

[11] Patent Number: 5,526,969

[45] Date of Patent: Jun. 18, 1996

[54] CONVERTIBLE BACKPACK

[75] Inventor: Susan Greenberger, Weston, Conn.

[73] Assignee: Thingamajig, Inc., Chadds Ford, Pa.

[21] Appl. No.: 274,839

[22] Filed: Jul. 14, 1994

[51] Int. Cl.[6] ..... A45F 4/12

[52] U.S. Cl. ..... 224/153.000; 224/580; 224/576; 224/579; 224/613; 224/653; 2/94; 2/69.5

[58] Field of Search ..... 224/151, 153; 2/94, 95, 69.5, 72, 86

[56] References Cited

U.S. PATENT DOCUMENTS

| | | | |
|---|---|---|---|
| 2,165,348 | 7/1939 | Daiber . | |
| 2,248,455 | 7/1941 | Freund . | |
| 2,779,024 | 1/1957 | Storfer . | |
| 4,068,314 | 1/1978 | Yellen et al. . | |
| 4,079,467 | 3/1978 | Baldwin . | |
| 4,272,852 | 6/1981 | Bell . | |
| 4,389,735 | 6/1983 | McLaughlin | 2/94 |
| 4,404,687 | 9/1983 | Hager | 2/94 |
| 4,475,251 | 10/1984 | Hopkins . | |
| 4,476,587 | 10/1984 | Itoi | 2/94 |
| 4,502,155 | 3/1985 | Itoi . | |
| 4,507,805 | 4/1985 | Calutoiu . | |
| 4,563,777 | 1/1986 | Park | 224/151 |
| 4,662,550 | 5/1987 | O'Donnell | 224/153 |
| 4,669,127 | 6/1987 | Swanson . | |
| 4,689,831 | 9/1987 | Greenberger et al. . | |
| 4,700,409 | 10/1987 | De Lott | 2/94 |
| 4,862,250 | 9/1989 | Gazzola . | |
| 5,010,592 | 4/1991 | Skiles, Jr. . | |
| 5,022,092 | 6/1991 | Bombrini . | |
| 5,123,117 | 6/1992 | Prendergast . | |
| 5,165,111 | 11/1992 | Lieberman . | |
| 5,247,707 | 9/1993 | Parker et al. . | |
| 5,278,998 | 1/1994 | Book | 224/151 |
| 5,407,112 | 4/1995 | Christodoulou et al. | 224/153 |

FOREIGN PATENT DOCUMENTS

| | | | |
|---|---|---|---|
| 228767 | 7/1987 | European Pat. Off. | 224/151 |
| 2948713 | 6/1981 | Germany | 224/153 |
| 2231254 | 11/1990 | United Kingdom | 224/151 |
| 8606939 | 12/1986 | WIPO | 224/151 |

*Primary Examiner*—Henry J. Recla
*Assistant Examiner*—Charles R. Eloshway
*Attorney, Agent, or Firm*—Cooper & Dunham

[57] ABSTRACT

A backpack is convertible between a backpack only mode and a backpack and protective outerwear mode. In the former mode, carrying straps and a second compartment are connected to the outside of a first compartment, and protective outerwear is connected to and stored on the inside of the first compartment. In the latter mode, the first compartment is inverted so that the second compartment and carrying straps are stored inside the first compartment, and the protective outerwear is external of the first compartment, so that the first compartment is located on the back of the protective outerwear to form a backpack. A support strap is fastened to the inside of the protective outerwear to provide support for a load carried in the first compartment and to enable the individual to carry heavier loads than possible without the support strap.

12 Claims, 2 Drawing Sheets

CONVERTIBLE BACKPACK

BACKGROUND OF THE INVENTION

Various backpacks exist which can be converted into protective outerwear, yet still retain the characteristics of a carrying bag. Such backpacks appeal mainly to hikers, campers, and other sports enthusiasts who appreciate the convenience of a backpack that can be optionally carried as a backpack only or as a backpack with outerwear, where the outerwear can be folded into a compact package and stored in the backpack with ease.

Such a convertible backpack is advantageous because it enables the user to choose a carrying method that best accommodates the user's needs. For example, carrying a backpack via carrying straps might reduce the amount of interference with the user's movement, whereas carrying a backpack via protective outerwear will protect the user from extreme weather conditions, such as rain or cold.

Convertible carrying bags previously have been designed so that the backpack carrying straps are located on the inside of the wearable outerwear to provide support when the backpack is carried via outerwear.

For example, U.S. Pat. No. 2,165,348 (Daiber) provides a jacket with an attached backpack and support straps attached to the inside of the jacket. The jacket converts into a bag by tucking the sleeves inside the jacket and closing the jacket behind itself and around the backpack, so that the support straps are on the outside of the backpack.

U.S. Pat. No. 4,502,155 (Itoi) provides a convertible backpack having an attached jacket that is folded into a compartment of the backpack. Support straps attached to the inside of the jacket are convertible to backpack carrying straps by drawing them from inside the jacket, through holes in the fabric, to the outside of the bag.

U.S. Pat. No. 5,165,111 (Lieberman) provides a combination backpack with outerwear that can be extracted from a compartment that extends around the periphery of the backpack. The backpack carrying straps serve as internal support straps when worn as outerwear.

These proposed designs are not advantageous because none provide a convertible backpack that is simple to use, that provide optional use of the backpack carrying straps in a backpack and protective outerwear mode to avoid discomfort, and that conveniently provide a separate compartment for storing the outerwear and for carrying other items. Furthermore, none of the proposed designs provide for quick and automatic conversion between backpack only and backpack and protective outerwear modes.

U.S. Pat. No. 4,689,831 issued to the applicant provides a garment that is converted into a carrying pack by inverting the pack and folding the garment into the pack. That patented invention solved some but not all of the foregoing problems, since it is primarily a convertible garment rather than a convertible backpack. The disclosure of U.S. Pat. No. 4,689,831 is incorporated herein by reference.

SUMMARY OF THE INVENTION

It is an object of the present invention to provide a backpack which can be carried on an individual's back with straps, or with protective outerwear.

It is a further object of the invention to provide a backpack which can be carried via a combination of protective outerwear and a support strap, to enable a user to carry heavy loads.

It is still another object of the present invention to provide a backpack that can be automatically converted from a backpack only mode to a backpack and protective outerwear mode simply by inverting a storage compartment.

It is yet another object of the invention to provide a convertible backpack that automatically stores protective outerwear in a compartment that is separate from other carrying items.

To these and other ends, the present invention contemplates a backpack that can be converted between a backpack only mode and a backpack and protective outerwear mode. In the backpack only mode, the backpack includes first and second compartments and carrying straps for carrying the backpack on an individual's back. The first compartment stores protective outerwear, and the second compartment stores carrying items.

The backpack is converted from the backpack only mode to the backpack and protective outerwear mode by inverting the first compartment, so that the protective outerwear is automatically external to the first compartment, and the second compartment and carrying straps are automatically enclosed within the first compartment. The first compartment thereby stores the carrying straps and the storage items and functions as the backpack.

The backpack is converted from the backpack and protective outerwear mode back into the backpack only mode by inverting the first compartment again so that the protective outerwear automatically is enclosed within the first compartment, and the second compartment and carrying straps automatically are external of the first compartment to form a backpack. However, in both modes, a backpack always is present.

According to the present invention, a user can optionally carry a backpack with the carrying straps, or with the protective outerwear, for optimal comfort and convenience. The user can convert the backpack between its two carrying modes simply by inverting a storage compartment, without additional zipping, pulling or folding. Moreover, by storing the protective outerwear and carrying items in separate compartments, the carrying items can be protected from dirt or water that may have soiled the protective outerwear.

The backpack of the present invention also includes a support strap. The ends of the support strap are fastened to the inside of the protective outerwear at positions corresponding to an upper corner and an opposite lower corner of the first compartment. Therefore, in the backpack and protective outerwear mode, the support strap may be worn diagonally across an individual's body to provide support for a load carried in the first compartment, and to enable the individual to carry heavier loads than possible without the support strap. The support strap is releasably attached for selective use.

The above and other objects, feature and advantages of the present invention will become apparent from the following detailed description of preferred embodiments when read in conjunction with the accompanying drawings, in which the same reference numerals are used to identify the same or similar parts in the several views.

DETAILED DESCRIPTION

Figure 1:
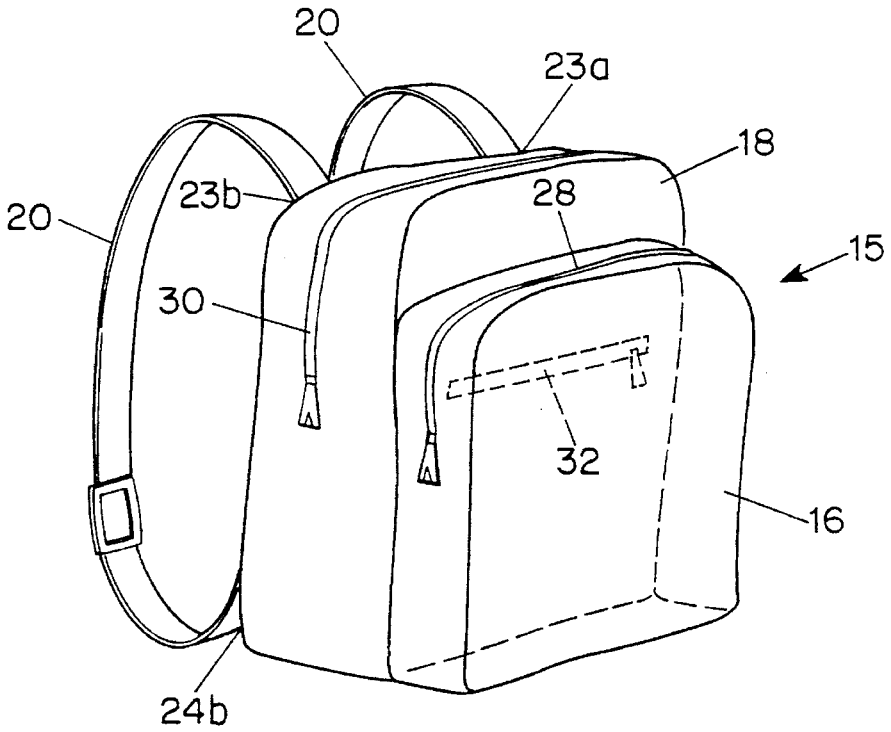
FIG. 1 is a front perspective view of the backpack in the backpack only mode.

FIG. 1 depicts the invention in the backpack only mode. The backpack 15 includes a first compartment 16 for carrying any desired objects, and a second compartment 18 for storing the protective outerwear portion of the bag. The backpack 15 further includes carrying straps 20, which have their ends secured to the top corners of the bag at 23*a*, 23*b*, and at the bottom corners of the bag 24*b*, 24*a* (not shown). The carrying straps 20 are adapted to be placed over an individual's shoulders, enabling the pack to be worn on the individual's back. Closure means 28, 30, such as a zipper, buttons, snaps or hook-and-eye fasteners, for example, may be used to secure the top of the compartments 16, 18, respectively. An opening 32 is provided between compartments 16 and 18, which also may be secured closed with closure means.

Figure 2:
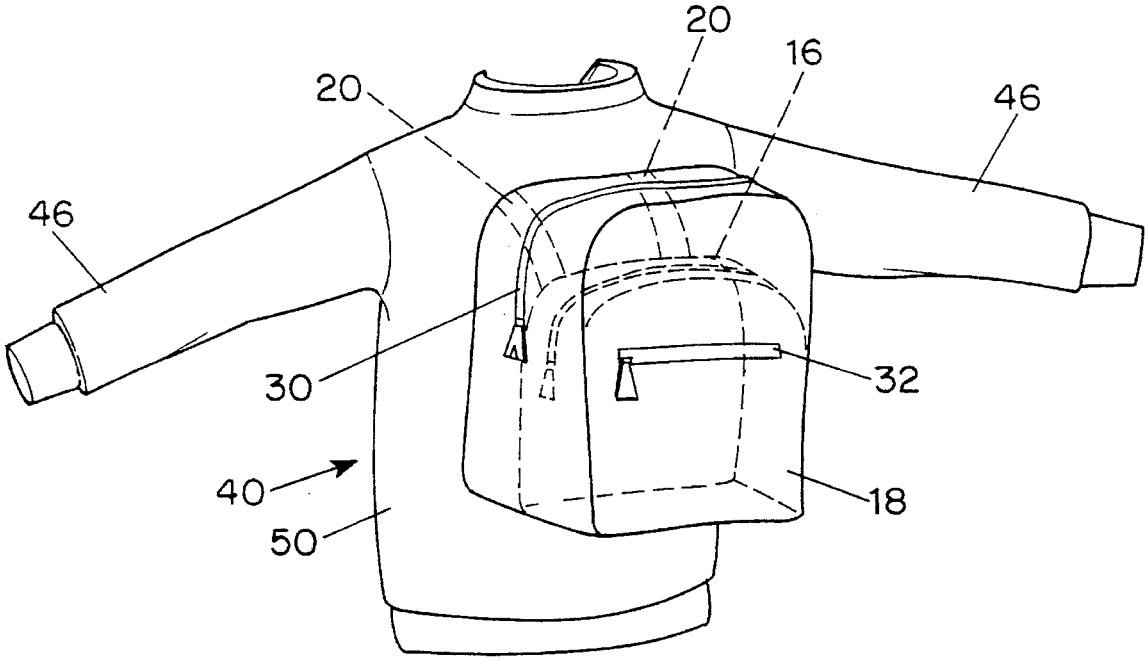
FIG. 2 is a back perspective view of the backpack in the backpack and protective outerwear mode.

FIG. 2 depicts the invention in the backpack and protective outerwear mode of the backpack. Preferably, the protective outerwear 40 is made in the form of a jacket having sleeves 46, front 48 and back 50. The protective outerwear also can be made in the form of a vest, a poncho, or any other convenient form. The outerwear also may include a hood, if desired.

Compartment 18 is exposed on the back 50 of the outerwear 40 for carrying storage items when the invention is in the backpack and protective outerwear mode. Alternatively, compartment 18 may be attached to the front or side of the protective outerwear, and the protective outerwear may have additional compartments as the user sees fit. Carrying straps 20 are stored inside the compartment 18 when in the backpack and protective outerwear mode.

Figure 5:
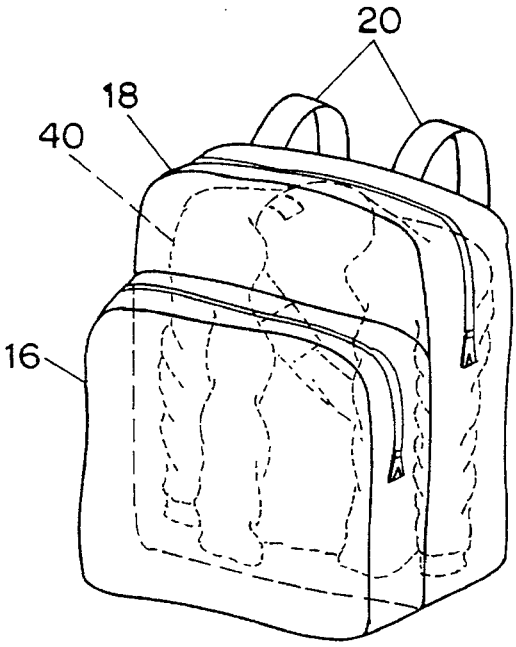
FIG. 5 is a front perspective view of the protective outerwear folded into the backpack.

Initially, in the backpack only mode 15, outerwear 40 is stored within compartment 18, as shown in phantom in FIG. 5. The backpack is convertible from the backpack only mode 15 into the backpack and protective outerwear mode 40 by opening the compartment 18 via closure 30 and inverting compartment 18. The protective outerwear 40 is automatically located on the outside of compartment 18, and compartment 16 and carrying straps 20 are automatically enclosed inside compartment 18, as shown in phantom in FIG. 2.

Opening 32, which is hidden between compartments 16 and 18 in the backpack only mode, is exposed on the outside of inverted compartment 18 in the backpack and protective outerwear mode 40 for accessing the inside of compartment 16, as shown in FIG. 2. Thus, in the backpack and protective outerwear mode, the inside of compartment 18 can be accessed through closure 30. Compartment 16 forms a sub-compartment within compartment 18, and the inside of that sub-compartment can be accessed through opening 32.

Outerwear 40 can be returned to the backpack only mode by opening the compartment 18 and turning it inside-out. Compartment 16 and carrying straps 20 automatically return to the outside of compartment 18 as it is being inverted. Outerwear 40, including the sleeves 46, are automatically returned to the inside of compartment 18. It is not necessary to zip, fold or stuff the outerwear into the storage compartment.

In this manner, the backpack can be converted between the backpack only mode and the backpack and protective outerwear mode without requiring the user to zip, pull or fold any portion of the backpack. Thus, a user can convert the backpack between its carrying modes quickly and with ease.

When opening 32 is fastened, compartment 18, with the outerwear inside, can be sealed off from the contents of compartment 16. This arrangement is particularly convenient when the protective outerwear has been soiled or is wet, and it is undesirable for the outerwear to contact other storage items.

Figure 3:
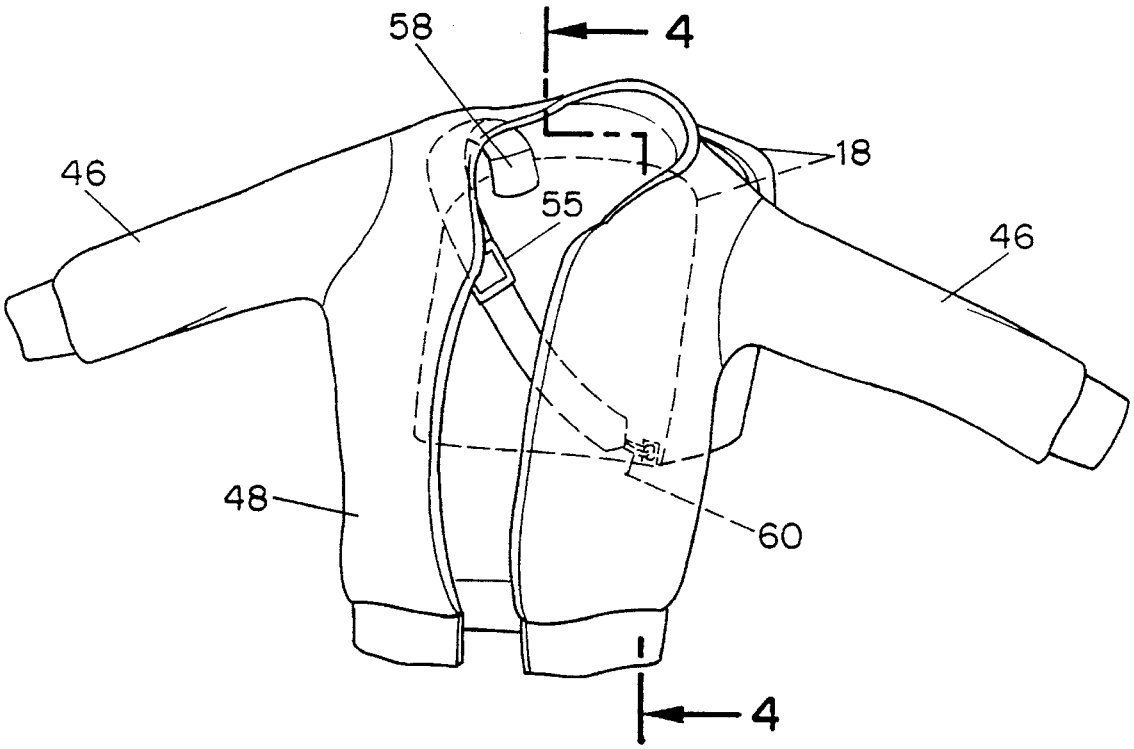
FIG. 3 is a front perspective view of the backpack in the backpack and protective outerwear mode.
Figure 4:
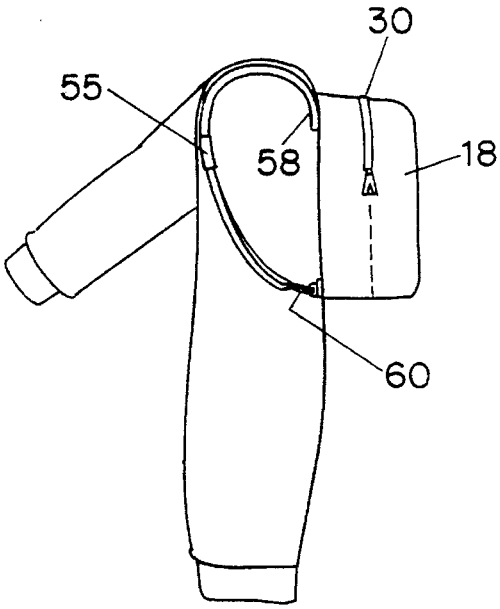
FIG. 4 is a cross sectional view along line 4—4 of FIG. 3.

The backpack includes a cross strap 55 for use in the backpack and protective outerwear mode, as shown in FIGS. 3 and 4. One end of the cross strap 55 is connected to the inside of the back 50 at a shoulder 58. The other end of the cross strap 55 is connected to the inside of the back 50 at the opposing waist 60. Preferably, the ends of the cross strap 55 also are connected through the outerwear to the corresponding corners of compartment 18, to ensure a secure connection.

Preferably, the cross strap 55 is releasably fastened to the protective outerwear at 58 and 60 by appropriate closure means, preferably a metal latch hook. Alternatively, cross strap 55 can be releasably fastened at one of the positions 58 or 60. The length of cross strap 55 may be adjustable by means commonly known in the art, to provide the individual with a comfortable fit.

The cross strap 55 enables the user to carry heavy loads by providing additional support to compartment 18. This additional support may allow the user to carry up to twenty pounds, depending on the strength of the material from which the protective outerwear and backpack are made, and the strength of the connections at 58 and 60. Prior garments convertible into backpacks could carry only about two pounds, as for example, in U.S. Pat. No. 4,689,831.

When the backpack is in the backpack only mode, removable cross strap 55 may be stored inside compartment 18 along with the protective outerwear 40, or in compartment 16, or any other convenient location. When the user puts on the protective outerwear, cross strap 55 is draped from connection 58, diagonally across the front of the user's chest, to connection 60, and fastened by the closure means. The length of cross strap 55 can be adjusted accordingly.

If cross strap 55 is permanently connected at 58 or 60, then it is automatically stored in compartment 18 along with the protective outerwear 40 in the backpack only mode. When the garment is converted into the backpack and protective outerwear mode, cross strap 55 is automatically removed from compartment 18 along with the outerwear when compartment 18 is inverted.

The backpack and protective outerwear are desirably formed of a sturdy, pliable material, such as cotton, nylon, or other woven materials. This permits the various elements of the device to be easily folded for conversion into the alternative modes of use, while being strong enough to support a heavy load. The backpack 40 desirably has closure means on the front, which may be a zipper, buttons, snaps, hook and eye fasteners or other closure means.

It should be appreciated that various modifications could be made in the structure of the convertible backpack without departing from the spirit and scope of the invention. These modifications would be apparent to those having skill in the art.

We claim:

1. A bag convertible between a backpack only mode and a backpack and protective outerwear mode comprising:

a first compartment with a first inside formed when the bag is in the backpack only mode, a first external surface formed when the bag is in the backpack only mode, a second inside formed when the bag is in the backpack and protective outerwear mode, and a second external surface formed when the bag is in the backpack and protective outerwear mode, said first external surface having carrying straps attached thereto;

a second compartment with a third inside formed when the bag is in either the backpack only mode or the backpack and protective outerwear mode, said second compartment being connected to said first external surface of said first compartment when the bag is in the backpack only mode and being connected to said second inside of said first compartment when the bag is in the backpack and protective outerwear mode;

protective outerwear connected to the first inside of the first compartment, whereby in the backpack only mode the carrying straps and the second compartment are attached to the first external surface of the first compartment and the protective outerwear is stored in the first inside of the first compartment, and in the backpack and protective outerwear mode the protective outerwear is attached to the second external surface of the first compartment and the second compartment and said carrying straps are stored in the second inside of the first compartment, the bag being converted between the backpack only mode and the backpack and protective outerwear mode by inverting the first compartment, the first inside of the first compartment being in communication with the third inside of the second compartment by an opening when the bag is in the backpack only mode.

2. A bag convertible between a backpack only mode and a backpack and protective outerwear mode, comprising:

a first compartment with a first inside formed when the bag is in the backpack only mode, a first external surface formed when the bag is in the backpack only mode, a second inside formed when the bag is in the backpack and protective outerwear mode, and a second external surface formed when the bag is in the backpack and protective outerwear mode, said first external surface having carrying straps attached thereto;

a second compartment with a third inside formed when the bag is in either the backpack only mode or the backpack and protective outerwear mode, said second compartment being connected to said first external surface of said first compartment when the bag is in the backpack only mode and being connected to said second inside of said first compartment when the bag is in the backpack and protective outerwear mode;

protective outerwear connected to the first inside of the first compartment, whereby in the backpack only mode the carrying straps and the second compartment are attached to the first external surface of the first compartment and the protective outerwear is stored in the first inside of the first compartment, and in the backpack and protective outerwear mode the protective outerwear is attached to the second external surface of the first compartment and the second compartment and said carrying straps are stored in the second inside of the first compartment, the bag being converted between the backpack only mode and the backpack and protective outerwear mode by inverting the first compartment, the first inside of the first compartment being in communication with the third inside of the second compartment by an opening when the bag is in the backpack only mode; and a support strap having first and second ends, each of said first and second ends being fastened to an inside surface of the protective outerwear at positions corresponding respectively to upper and lower corners of the second external surface of the first compartment, whereby in the backpack and protective outerwear mode the support strap may be worn across an individual's body to provide support for a load carried in the second inside of the first compartment, to enable the individual to carry heavier loads than possible without the support strap.

3. A bag as defined in claim 2, further comprising fastening means whereby at least one end of the support strap is releasably fastened to the inside of the protective outerwear.

4. A bag as defined in claim 2, wherein the first and second ends of the support strap are fastened both to the protective outerwear and to the second external surface of the first compartment.

5. A combined backpack with garment, said garment having a front portion and a back portion, said combined backpack being convertible between a backpack only mode and a backpack and garment mode, comprising:

a first compartment located on the back portion of the garment, said first compartment having a first inside formed when the combined backpack is in the backpack only mode, a first external surface formed when the combined backpack is in the backpack only mode, a second inside formed when the combined backpack is in the backpack and garment mode, and a second external surface formed when the combined backpack is in the backpack and garment mode;

carrying straps with first and second ends fastened at each of said first and second ends to the first external surface of the first compartment; and a second compartment with a third inside formed when the combined backpack is in either the backpack only mode or the backpack and garment mode, said second compartment being attached to the second inside of the first compartment when the combined backpack is in the backpack and garment mode and being attached to said first external surface of said first compartment when the combined backpack is in the backpack only mode;

whereby the garment is disposed on the first inside of the first compartment when the combined backpack is in the backpack only mode, and the carrying straps and the second compartment are disposed on the first external surface of the first compartment when the combined backpack is in the backpack only mode, wherein a two-chambered backpack is formed which is adapted to be worn on an individual's back and to be held thereon by the carrying straps and wherein said first inside of said first compartment is in communication with the third inside of the second compartment by an opening when the combined backpack is in the backpack only mode.

6. A combined backpack with garment according to claim 5, further comprising fastening means for selectively closing the opening between the first and second compartments.

7. A combined backpack with garment as defined in claim 5, wherein the garment is made in the form of a jacket.

8. A combined backpack with garment as defined in claim 5, wherein the garment is made in the form of a vest.

9. A combined backpack with garment as defined in claim 5, wherein the garment is made in the form of a poncho.

10. A combined backpack with garment, said garment having a front portion and a back portion, said combined backpack being convertible between a backpack only mode and a backpack and garment mode, comprising:

a first compartment located on the back portion of the garment, said first compartment having a first inside formed when the combined backpack is in the backpack only mode, a first external surface formed when the combined backpack is in the backpack only mode, a second inside formed when the combined backpack is in the backpack and garment mode, and a second external surface formed when the combined backpack is in the backpack and garment mode;

carrying straps with first and second ends fastened at each of said first and second ends to the first external surface of the first compartment;

a second compartment with a third inside formed when the combined backpack is in either the backpack only mode or the backpack and garment mode, said second compartment being attached to the second inside of the first compartment when the combined backpack is in the backpack and garment mode and being attached to said first external surface of said first compartment when the combined backpack is in the backpack only mode;

whereby the garment is disposed on the first inside of the first compartment when the combined backpack is in the backpack only mode, and the carrying straps and the second compartment are disposed on the first external surface of the first compartment when the combined backpack is in the backpack only mode, wherein a two-chambered backpack is formed which is adapted to be worn on an individual's back and to be held thereon by the carrying straps and wherein said first inside of said first compartment is in communication with the third inside of the second compartment by an opening when the combined backpack is in the backpack only mode; and a support strap with first and second ends, each of said first and second ends being fastened to an inside of the garment at positions corresponding respectively to upper and lower corners of the second external surface of the first compartment, whereby the support strap may be worn across an individual's body to provide support for a load carried in the first inside of the first compartment, to enable the individual to carry heavier loads than possible without the support strap.

11. A combined backpack with garment as defined in claim 10, further comprising fastening means whereby at least one end of the support strap is releasably fastened to the inside of the garment.

12. A combined backpack with garment as defined in claim 10, wherein the first and second ends of the support strap are fastened both to the garment and to the second external surface of the first compartment.

* * * * *